United States Patent [19]

Best

[11] Patent Number: 4,471,997

[45] Date of Patent: Sep. 18, 1984

[54] METHOD FOR DEPOSITING DUST DURING HYDRAULICKING OF MINERALS BY A CUTTER ROLLER OF A MINING MACHINE

[75] Inventor: Gerd Best, Sprockhövel, Fed. Rep. of Germany

[73] Assignee: Krampe & Co., Fertigung in Bergbaubedarf GmbH, Hamm, Fed. Rep. of Germany

[21] Appl. No.: 354,911

[22] Filed: Mar. 4, 1982

[30] Foreign Application Priority Data

Jul. 3, 1981 [DE] Fed. Rep. of Germany ..... 3126229

[51] Int. Cl.[3] ..... E21C 35/22

[52] U.S. Cl. ..... 299/12; 299/81

[58] Field of Search ..... 299/12, 81

[56] References Cited

U.S. PATENT DOCUMENTS

| | | | |
|---|---|---|---|
| 3,904,246 | 9/1975 | Gandy et al. | 299/89 |
| 4,084,855 | 4/1978 | Miles | 299/81 |
| 4,249,779 | 2/1981 | Best | 299/81 |
| 4,315,658 | 2/1982 | French et al. | 299/12 |

FOREIGN PATENT DOCUMENTS

| | | | |
|---|---|---|---|
| 2019920 | 11/1979 | United Kingdom | 299/81 |

*Primary Examiner*—William F. Pate, III

*Attorney, Agent, or Firm*—Michael J. Striker

[57] ABSTRACT

A cutting roller for a mining machine is provided with an arrangement for dust depositing and cooling cutter bits disposed on the cutting roller. The arrangement includes Venturi nozzles mounted in a closure ring enclosing the front end of the cutting roller, which closure ring faces the workings of a mineral to be processed. Spraying liquid supplied to the Venturi nozzles is discharged therefrom in strong jets directed to the workings and deflected therefrom to form branches of spraying liquid mist flowing around the cutting roller. The spraying liquid mist enriched with dust is sucked into the cutting roller and flows back to the nozzles where it is mixed with the freshly supplied spraying liquid.

4 Claims, 2 Drawing Figures

METHOD FOR DEPOSITING DUST DURING HYDRAULICKING OF MINERALS BY A CUTTER ROLLER OF A MINING MACHINE

BACKGROUND OF THE INVENTION

This invention relates to a cutting roller for a mining machine. More particularly, the invention relates to means for dumping dust generated during mining of minerals and to a method of distributing spraying liquid supplied to the cutting roller for dumping the dust.

Conventional cutting rollers for underground mining of the type under discussion include a tubular housing or body, the so-called tube member, on which one or more cutting blades is or are welded so as to extend helically about the tubular housing. Welded on to the outside of the blades at regular intervals are bit holders in which cutter bits are mounted. The end of the cutting roller facing towards the face of the workings is closed off by an end plate.

Cutting rollers of this kind are also known wherein the cutting rollers are provided with a so-called conical closure ring, also known as a conical closure member. This closure ring is fixedly connected to the end plate by welding. The conical closure member is also provided at regular intervals around its outer edge, projecting towards the face of the workings, with bit holders in which cutter bits are mounted, these bits consequently projecting substantially beyond the outer edge region of the conical closure member towards the face of the workings.

Means for spraying liquid around the cutting roller are known in the art. These means involve individual nozzles arranged on the roller. Each spraying nozzle is mounted in the cutter bit so that a spraying liquid jet produced thereby is directed from the cutter bit, which jet cools the bit.

It has been also known in the art to use spraying nozzles for damping or depositing dust generated in the mining process. This, however was not proven effective. Spraying liquid has been supplied to the aforementioned individual nozzles through channels extended within the interior of the cutting roller, which leads to some problems. The installation of individual nozzles in all cutter bits has required many individual channels extended through cutter blades to deliver spraying fluid to the nozzles; this has been found costly and inconvenient. Furthermore, spraying nozzles produced with rather high quality become disturbed by rough working conditions in underground mining and may not only be damaged by a mineral discharged from the workings but can also be damaged at least partially by corrosion. This results in that flowing spraying liquid selects on its way to the nozzles lesser resistance and therefore does not reach all the nozzles. This leads to the fact that the cutting roller is not fully surrounded with spraying liquid; this deteriorates dust damping process. Specifically those nozzles which are mounted at the discharging end of the cutting roller become subject to wear by abrasive mineral after relatively short charging time. In this case all the supply channels are exposed to spraying liquid which under such conditions can leak out. This results in that pressure within the spraying liquid supply system will be reduced so that the function of the majority or all spraying nozzles will worsen and neither proper cooling of cutter bits nor required dust damping will be achieved.

Finally, it is to be noted that spraying liquid consuption in case of the use of individual spraying nozzles is considerable which is undesirable due to high costs of energy at the present time.

SUMMARY OF THE INVENTION

It is an object of the invention to provide improved dust depositing means on a cutting roller of a mining machine.

Another object of the invention is to reduce the amount of spraying liquid to be used for dust damping by utilizating the same spraying liquid to be sprayed out of the spraying nozzles for several times.

Still another object of the invention is to install means for dust damping at the area of the cutting roller where dust occurs.

These and other objects of the invention are attained by a method of depositing dust during hydraulicking of minerals in a mining process by means of a cutting roller having a front end facing the workings and a discharge end, wherein spraying liquid is supplied to and discharged from nozzles formed on the cutting roller and spraying liquid mist is formed in the area of the cutting roller, the method comprising the steps of providing a circulation of at least a portion of the spraying liquid mist enriched with dust during the mining process around the cutting roller, providing sucking of said mist into the cutting roller, mixing said mist with a newly supplied spraying liquid to obtain a mixture, and discharging said mixture from the nozzles on the cutting roller.

One of the advantages of the present invention is that a conventional cutting roller should not be considerably reconstructed in order that the novel means of the invention be installed thereon.

Since the same spraying liquid after being discharged from the nozzles is sucked into the cutting roller and mixed with the newly supplied liquid the relatively large amount of spraying liquid can be saved.

Further advantage of the invention resides in that spraying liquid mist surrounding the cutting roller forms closed envelope around the cutting roller so that spraying liquid flows exactly in the space where dust occurs. By varying underpressures and with suction of spraying fluid enriched with dust into the cutting roller it is possible to determine the expansion of the liquid spraying mist whereby density of this mist may be controlled. Under higher under-pressures this mist will tend closer to the cutting roller and a denser spraying liquid mist will be produced resulting in intensive dust depositing and cooling of the cutter bits.

Furthermore, because of installation of dust-depositing means at the certain area of the cutting roller it is possible to control a stream of spraying liquid and dust so that this stream will flow from the front end of the cutting roller to the roof of the seam and floor of the seam; in other words the stream will flow in the areas where dust is concentrated.

In accordance with further features of the invention at least two strong jets of spraying liquid may be produced, which jets are directed to the workings from front end of the cutting roller.

By provision of at least two strong jets of spraying liquid very effective stream of liquid is produced, which stream is discharged from the nozzles with very high velocity and deflected into two branches forming spraying liquid mist and flowing around the periphery of the cutting roller and passing the areas near the roof of the seam and floor of the seam. Spraying liquid mist enriched with dust is then sucked into the cutting roller at the discharging end thereof and mixed with the newly supplied liquid.

The objects of the invention are further attained by a structure of the cutting roller, comprising a tubular body member, a number of cutting blades helically extended on said body member and provided with bits, a closure member closing the front end of the roller and facing the workings, and a plurality of spraying nozzles arranged in the closure member, the spraying nozzles being Venturi nozzles to form stronger jets of spraying liquid supplied to the nozzles, said jets being directed towards the workings and deflected from said front end to form spraying liquid mist.

The roller may further include spraying liquid supplying channels arranged within the interior of the body member and connected to said nozzles. The nozzles communicate with the interior of the body member.

The roller may further comprise a flange element mounted within the body member, the flange element being formed with a plurality of through passages.

The body member may be formed with a circular suction passage extending between the flange element and the discharge end of the cutting roller, the through passages connecting the interior of the body member with the suction passage.

The cutter blades may be formed with a plurality of suction channels communicating an external space around the cutting roller with the interior of the body member.

It can also be managed that when spraying liquid enriched with dust is sucked to one set of the nozzles fresh spraying liquid may be supplied to another set of the nozzles.

The cutting roller of the invention has a simple and rigid structure with a small number of spraying nozzles and with a simple liquid supplying channel system for supplying fresh spraying liquid. The coils do not require additional liquid supplying channels so that trouble incidence of the cutting roller is substantially reduced.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
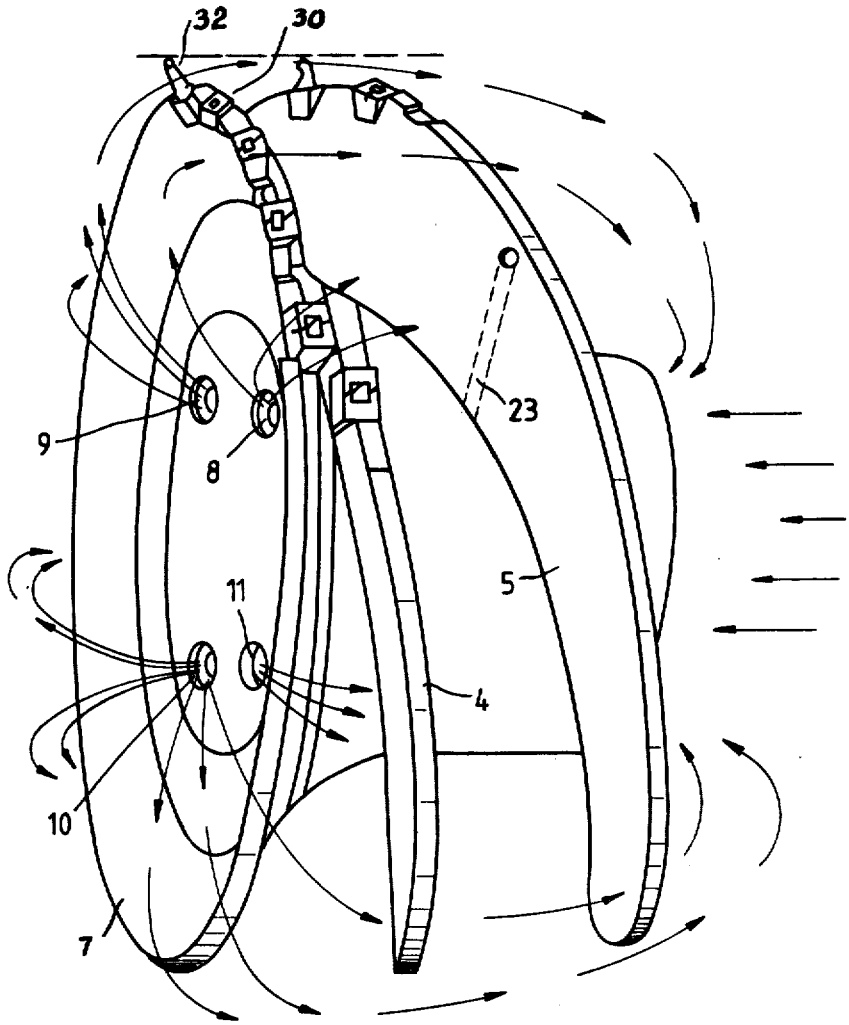
FIG. 1 is a perspective view of a cutting roller according to the invention.

In the drawings the invention is shown with reference to a cutting roller which may be used particularly in underground coal mining.

Figure 2:
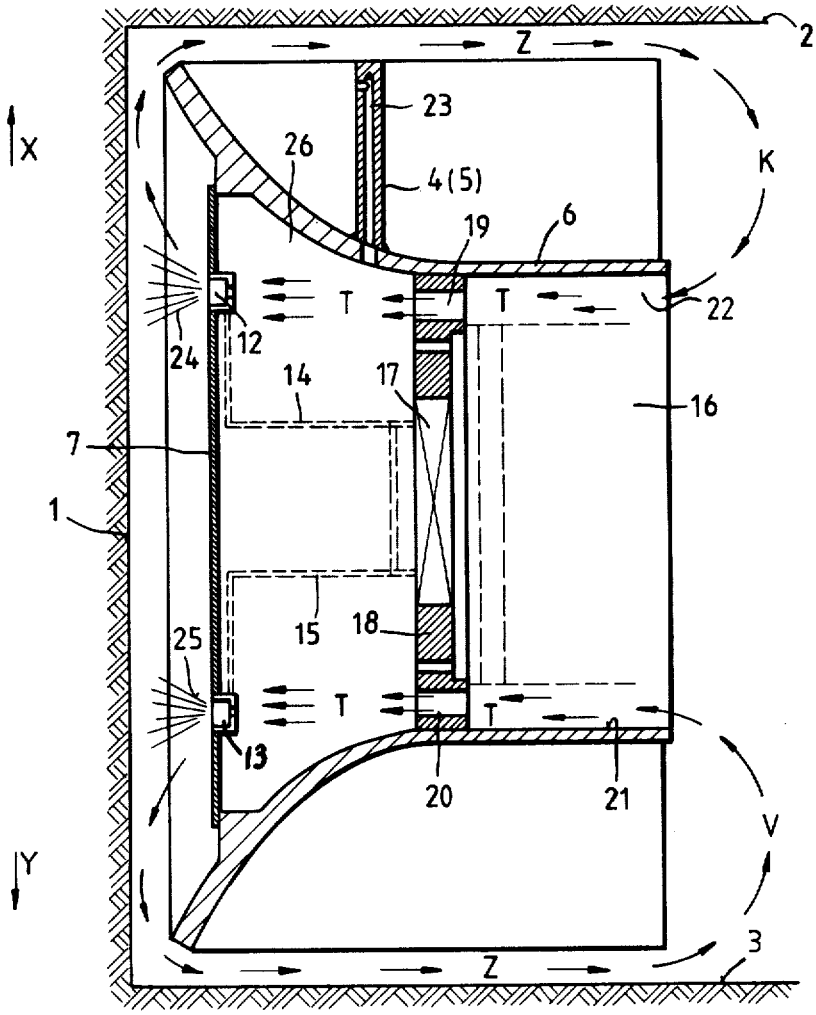
FIG. 2 is a partial axial section through the roller illustrated in FIG. 1.

Referring to FIGS. 1 and 2, it is seen that a cutting roller for underground mining is normally placed in a mine so that it faces a face of workings denoted as 1 and is positioned between a roof of the seam 2 and a floor of the seam 3.

The cutting roller includes a tubular body member 6 which is provided with a number of blades 4, 5 helically extended about an outer periphery of the body member.

Each blade is provided on its outer periphery, with bit holders 30 arranged at regular intervals and rigidly connected to the associated blade by welding. All the bit holders are furnished with outwardly projecting bits 32 which cut into a mineral.

Blades 4, 5 may be connected to body member 6 by welding or any other suitable means. The body member 6 is so constructed that it extends in a curve over its outer surface. This curve may be preferably exponental curve so that at the end facing the face of workings the tubular body member is of its greatest external diameter and at its discharge end this member has its smallest outer diameter. The cutting roller is closed at its front end in a usual fashion with a conical ring-like enclosure 7 which, as known in the art, is connected to the body member by means of welding.

A number of openings 8, 9, 10, 11 are provided at the inner surface of enclosure 7 (four openings are shown in FIG. 1p Venturi nozzles 12 and 13 as well as all the remaining Venturi nozzles are connected to conduits or channels 14 and 15 through which spraying liquid is fed to nozzles 12, 13 from liquid supplying channels not shown herein. Liquid supplying channels are in turn connected to a source of pressure liquid, for example pump equipment or the like.

With reference to FIG. 2 reference character 16 schematically shows a planetary reduction gear. It is to be understood that any other suitable dnels are in turn connected to a source of pressure liquid, for example pump equipment or the like.

With reference to FIG. 2 reference character 16 schematically shows a planetary reduction gear. It is to be understood that any other suitable drive may be used for driving a cutting roller.

Reference character 17 denotes an element for connecting the drive to the roller, this element may be an axle journal which is engaged with the roller by a drive flange 18. It is understood that the cutting roller rotates about the planetary drive 16.

Two through passages 19 and 20 are formed in the flange 18, which passages interconnect a circular space 22 formed between the inner wall 21 of the body member and planetary drive 16 with an internal space 26 within the body member 6. Of course, more then two through passages may be provided in flange 18 in a circumferential direction thereof. The circular space 22 extends between the flange 18 and the discharge end of the body member.

Blades 4 and 5 each has a number of suction channels, only one channel 23 is shown for the sake of simplicity.

The fashion of circulation of spraying liquid about the cutting roller is as follows:

Let's assume that a process of hydraulicking of minerals began. Simultaneously spraying liquid is supplied from an appropriate source and spraying liquid conduits through channels 14 and 15 into all Venturi nozzles. The circulation of spraying liquid through nozzles 12 and 13 is shown in FIG. 2. Spraying liquid jets 24 and 25 discharged from nozzles 12 and 13 are substantially stronger than those provided by conventional nozzles. For example, spraying jets with two to twenty branches, preferably four to ten branches, as compared to one branch jet of conventional spraying nozzles, are discharged from the Venturi nozzles towards the face of workings 1, and non-chapped they will then deflect in directions to the roof of seam 2 and the floor of seam 3

Due to the fact that all the spraying nozzles are formed as Venturi nozzles air will be sucked in a direction shown by arrows T so that spraying liquid will circulate in a stream shown by arrows Z, K and T for the upper nozzle 12 and in a stream shown by arrows Z, V and T for the lower nozzle 13. This will result in that at least a portion, preferably larger portion, of the spraying liquid, which was supplied to nozzles 12 and 13 and produced jets 24 and 25 before, will be mixed with dust and sucked again by those nozzles. The thus formed dust-spraying liquid mixture will be mixed with a newly supplied spraying liquid in spraying nozzles 12 and 13 and discharged from the latter through jets 24 and 25. Such cycle will smitted then into the space 26 from where the mixture will be drawn into wake of nozzles 12 and 13 and thus added to spraying liquid therein. It is to be realized that more than one suction channel can be provided along the circumference of blades 4 and 5.

The spraying liquid-dust-mist circulates around the cutting roller from the its front end to its discharge end.

It will be understood that each of the elements described above, or two or more together, may also find a useful application in other types of a method for damping dust during a mining process differing from the types described above.

While the invention has been illustrated and described as embodied in methods for damping down dusts during a mining process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of depositing dust during hydraulicking of minerals in a mining process by means of a cutting roller having a front end facing the workings and a discharge end and positioned between a roof of a seam and a floor of a seam, wherein spraying liquid is supplied to and discharged from nozzles formed on the cutting roller and spraying liquid mist is formed in the area of the cutting roller, the method comprising the steps of providing a circulation of at least a portion of spraying liquid mist enriched with dust during the mining process around the cutting roller, providing sucking of said mist into the cutting roller, mixing said mist with a newly supplied spraying liquid to obtain a mixture, and discharging said mixture from the nozzles on the cutting roller, said circulation step including producing at least two strong jets of spraying liquid mist discharged from said front end of the cutting roller in the direction towards the workings, said jets being deflected from the front end of the cutting roller and then flowing in two paths, one path being formed between the cutting roller and the roof of the seam and a second path being formed between the cutting roller and the floor of the seam, the spraying liquid being mixed with dust in said two paths so that spraying liquid-dust-mist is produced, which flows about the periphery of the cutting roller from the front end thereof to the discharge end thereof, the spraying liquid-dust mist being then mixed with the newly supplied spraying liquid in the cutting roller.

2. In a cutting roller for a mining machine, having a front end and a discharge end and provided with means for spraying liquid for depositing dust in a mining process, a combination comprising a tubular body member; a number of cutting blades helically extended on said body member and provided with bits; a closure member closing the front end of the roller and facing the workings; a plurality of spraying nozzles arranged in the closure member, said spraying nozzles being Venturi nozzles to form strong jets of spraying liquid mist supplied to the nozzles, said jets being directed towards the workings and deflected from said front end to form spraying liquid mist; spraying liquid supplying channels arranged within the interior of the body member and connected to said nozzles, said nozzles being in communication with the interior of the body member; and a flange element mounted within said body member, said flange element being formed with a plurality of through passages, said body member being formed with a circular suction passage extending between said flange element and the discharge end of the cutting roller, said through passages connecting the interior of the body member with said suction passage.

3. The combination of claim 2, said body member being formed with a circular suction passage extending between said flange element and the discharge end of the cutting roller, said through passages connecting the interior of the body member with said suction passage.

4. The combination of claim 2, wherein said blades are formed with a plurality of suction channels connecting an external space around the cutting roller with the interior of the body member.

* * * * *